United States Patent [19]

Tokunaga et al.

[11] 4,416,533

[45] Nov. 22, 1983

[54] NONIMPACT PRINTER

[75] Inventors: Kazuyoshi Tokunaga, Katsuta; Masayasu Anzai, Hitachi, both of Japan

[73] Assignee: Hitachi, Ltd., Tokyo, Japan

[21] Appl. No.: 379,913

[22] Filed: May 19, 1982

Related U.S. Application Data

[63] Continuation of Ser. No. 93,034, Nov. 9, 1979, abandoned.

[30] Foreign Application Priority Data

Dec. 19, 1978 [JP] Japan ..... 53-155791

[51] Int. Cl.[3] ..... G03G 15/01; G03G 15/08

[52] U.S. Cl. ..... 355/4; 355/3 DD

[58] Field of Search ..... 355/1, 3 R, 3 TR, 3 DD, 355/4

[56] References Cited

U.S. PATENT DOCUMENTS

| | | | |
|---|---|---|---|
| 3,045,644 | 7/1962 | Schwertz | 355/4 X |
| 3,057,720 | 10/1962 | Hayford et al. | 430/103 X |
| 3,702,483 | 11/1972 | Fantuzzo | 355/4 X |
| 3,838,919 | 10/1974 | Takahashi | 355/4 |
| 3,999,849 | 12/1976 | Maksymiak et al. | 355/3 DD |
| 4,081,571 | 3/1978 | Nishihama et al. | 355/3 DD X |
| 4,135,927 | 1/1979 | Draugelis et al. | 355/4 X |
| 4,188,110 | 2/1980 | Stange | 355/4 X |
| 4,200,387 | 4/1980 | Masumura | 355/3 DD |
| 4,210,448 | 7/1980 | Forgo | 430/126 |

FOREIGN PATENT DOCUMENTS

| | | | |
|---|---|---|---|
| 2215159 | 10/1972 | Fed. Rep. of Germany | 355/4 |
| 1520404 | 8/1978 | United Kingdom | 355/4 |

*Primary Examiner*—Fred L. Braun

*Attorney, Agent, or Firm*—Antonelli, Terry & Wands

[57] ABSTRACT

A nonimpact printer in which electric charges are distributed over the surface of an electrophotographic photosensitive drum by a corona charger, the corona charged surface of the drum is exposed to a first information light, the induced latent image is developed by toner of a first color, the corona charged surface of the drum with the developed image of the toner of the first color is again exposed to a second information light, and the secondly induced latent image is developed by toner of a second color, so that a bicolor toner image is formed on the surface of the drum, which is transferred on a printing medium to obtain a print.

11 Claims, 13 Drawing Figures

NONIMPACT PRINTER

This is a continuation of application Ser. No. 093,034, filed Nov. 9, 1979, now abandoned.

BACKGROUND OF THE INVENTION

This invention relates to a nonimpact printer using an electrostatic recording technique such as electronic photography, and more particularly to a nonimpact printer which is suitable for bicolor printer.

Recently, numerous nonimpact printers have been developed which make effective use of the high printing speed of an electrostatic recording system such as electronic photography. Such a nonimpact printer generally has the following constitution. An electrophotographic photosensitive drum is used and the surface of the drum is uniformly corona charged under dark conditions by a corona charger. Thereafter, through an exposure process, latent images of a rectangular lattice for chits and/or repeated patterns are usually formed on the surface of the drum and the latent images according to the information as the output of an electronic computer are formed on the surface of the drum through the laser light exposure. By developing the thus formed latent image with toner is formed a toner image which is to be transferred to a printing medium to obtain a print.

With such a print, e.g. a document, if the rectangular lattice and the calculated value or data are printed in different colors, the printed content is easily read and understood, as is experienced usually.

SUMMARY OF THE INVENTION

The object of this invention is to provide a nonimpact printer capable of producing a print with clear images recorded in at least two colors.

According to this invention, there is provided a nonimpact printer comprising means for forming a first latent image of electric charges on a recording medium, first developing means for developing the first latent image, means for forming a second latent image of electric charges on the recording medium on which the first latent image has been developed into a visible image, and second developing means for developing the second latent image in a color different from the color used to develop the first latent image into the visible image, the bias voltage for the second developing means being set higher than the bias voltage for the first developing means.

DESCRIPTION OF THE PRIOR ART

Figure 1:
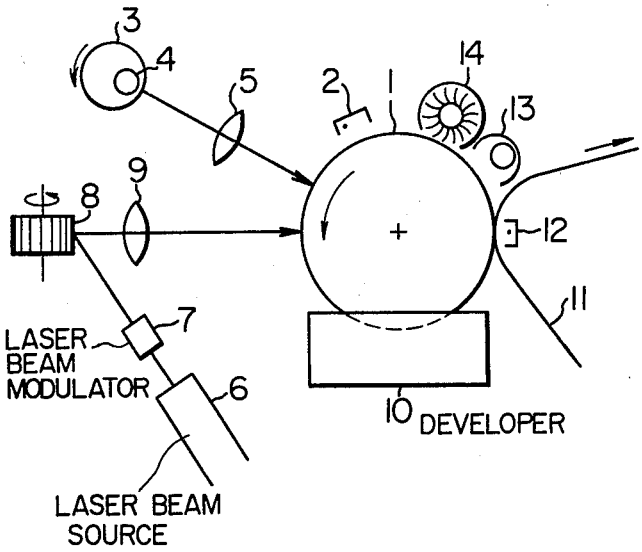
FIG. 1 PRIOR ART
FIG. 1 schematically shows the constitution of an ordinary nonimpact printer of electrophotographic type.

FIG. 1 schematically shows a typical example of a conventional nonimpact printer. Referring to FIG. 1, reference numeral 1 designates an electrophotographic photosensitive drum, 2 a corona charger, 3 an overlay film, 4 a light source for overlay printing, 5 a focusing lens, 6 a laser beam source, 7 a laser beam modulator, 8 a mirror scanner, 9 a focusing lens, 10 a developer, 11 a copying medium, 12 a corona charger for image transfer, 13 a residual charge removing lamp, and 14 a residual toner image remover. Electric charges are uniformly distributed over the surface of the photosensitive drum 1 under dark conditions by the corona charger 2. The photosensitive drum 1 is exposed to both overlay light and laser beam. The overlay light is the light which is generated by the overlay light source 4, passes through the overlay film 3 carrying ruled lines mainly for a document or routine patterns, i.e. format, to be repeatedly printed thereon, and then is focused by the lens 5. On the other hand, the laser beam to be projected on the drum 1 is the beam which is generated by the laser emitter 6, converted to an on-off or intensity-modulated signal according to an electric signal, not shown, by the laser light modulator, subjected to linear scanning by the mirror scanner 8, and then focused by the lens 9. The output information from a computer is converted to visible images described later by the laser exposure system described above.

After the exposure to the overlay light or the laser beam, a latent image of electric charges is formed on the surface of the drum 1. The latent image is then converted to a toner picture by means of the developer 10. This toner picture is transferred by the corona charger 12 for transfer onto the copying medium 11 which is driven at a speed equal to that of the periphery of the drum 1.

The above latent image and toner picture still remain on the drum 1, but they are completely removed by means of the residual charge removing lamp 13 and the residual toner remover 14. Accordingly, the surface of the drum 1 is cleaned up to be prepared for the next cycle of recording.

DETAILED DESCRIPTION OF THE PREFERRED EMBODIMENT

It is possible to propose such a bicolor printing system using electrophotographic techniques as described below. First, a corona charged photosensitive medium is exposed to the light containing first information and the formed latent image is developed by a first developing unit to form a first visible image. Secondly, the photosensitive medium with the first visible image formed thereon is exposed to the light containing second information and the thus formed second latent image is developed by a second developing unit to form a second visible image the color of which is different from that of the first visible image. In the following transferring step, the first and second visible images on the photosensitive medium are simultaneously or successively transferred onto a copying medium to complete a bicolor print.

According to this bicolor printing system, however, the toner image formed on the photosensitive medium, e.g. a drum, in the first developing step is partially erased or made thin during the second developing step and the toner used in the first development may sometimes contaminate the second toner image formed in the second developing step. This is a drawback of this system. This will not only cause the decrease in the contrast of the first toner image and the deterioration in the characteristic of the second development by the contamination of the first toner, but also, in an extreme case, may make the second development completely ineffective.

The present invention will now be described by way of embodiment with the aid of the accompanying drawings.

Figure 2:
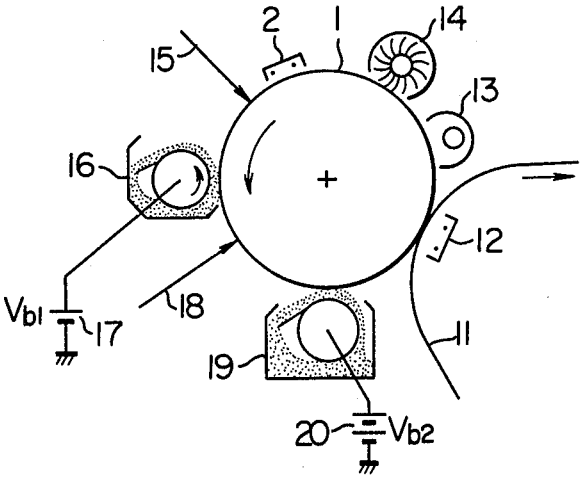
FIG. 2 schematically shows the constitutions of the exposing and developing sections of a bicolor nonimpact printer of electrophotographic type according to an embodiment of this invention.

FIG. 2 illustrates the operating principle of the exposing and developing sections of a nonimpact printer for producing bicolor prints, as an embodiment of this invention. In FIG. 2, reference numeral 15 designates a first exposing light source, 16 a first developing unit, 17 a first developing bias voltage source, 18 a second exposing light source, 19 a second developing unit, and 20 a second developing bias voltage source. Here, the description of the parts which are also used in an ordinary nonimpact printer of electrophotographic type shown in FIG. 1, will be omitted to avoid duplication.

FIGS. 3*a* to 3*e* show the steps of the printing process according to the nonimpact printer shown in FIG. 2. In the figures, cross mark + indicates a positive charge and circled cross mark ⊕ designates a particle of toner.

Figure 3A:
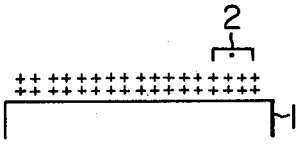
FIGS. 3*a* to 3*e* show the steps of the printing process according to the nonimpact printer shown in FIG. 2.
Figure 3B:
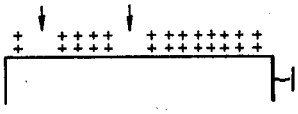

First, the electrophotographic photosensitive drum 1 has its surface corona charged uniformly by the corona charger 2, as shown in FIG. 3*a*. In this case, the surface of the drum 1 is kept at a potential of about 700 V. The drum 1 with its surface corona charged is exposed, as shown in FIG. 3*b*, to the light generated by the first exposing light source 15 and carrying the first information to be printed in a first color. The residual potential at the exposed area of the drum surface is about 0~300 V.

Figure 3C:
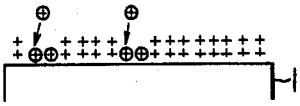

The latent image formed as a result of the above exposure is then developed by the first developing unit 16 to form a visible image in the first color, as shown in FIG. 3*c*. The potential at the exposed area of the drum surface rises by the application of toner particles having positive charges. A bias voltage $V_{b1}$ of about 0~300 V is applied from the first bias voltage source 17 to the first developing unit.

These steps of the first electrification, exposure and development are the same as those used in an ordinary nonimpact printer of electrophotographic type. In such a nonimpact printer, the reversal development is usually employed to prevent the fog of the background of the record. Namely, the charges on the drum surface are partially dissipated by the exposure to light in accordance with the lines constituting the original picture and the surface portion with the charges dissipated is applied with toner. For example, take a photosensitive medium of selenium as an example. Then, the surface of the photosensitive medium is positively corona charged and the potential at the exposed area corresponding to the lines of the original picture approximates to the ground potential because of the charge dissipation. It is well known that the developer is composed of carrier tending to be negatively charged through friction and toner tending to be positively electrified and that the toner image is formed in the area from which charges are dissipated. The above biasing voltage $V_{b1}$ is useful in improving the developing efficiency.

Figure 3D:
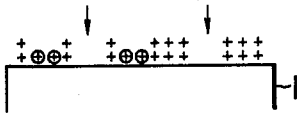
Figure 3E:
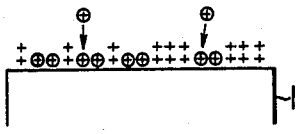

To effect bicolor printing, the photosensitive medium 1 with the first latent image developed in the first color is again exposed to the light emitted from the second exposing light source 18 and carrying the second information (in this case the exposed area has a residual of about 0~300 V as in the first exposure), as shown in FIG. 3*d* and the thus induced latent image is to be developed by the second developing unit into a visible image in the second color, as shown in FIG. 3*e*. Here, if the second latent image is developed simply through the conventional method, the toner supplied from the first developing unit and adhered on the photosensitive medium is partially removed and contaminates the toner in the second developing unit, as described above. This causes the decrease in the contrast of the first toner image and also the deterioration of the property of the second developing toner.

Figure 4A:
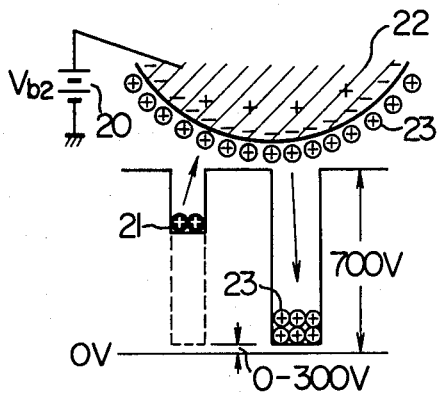
FIGS. 4*a* and 4*b* illustrate the developing operation of the second developing unit used in the nonimpact printer embodying this invention.

The above undesirable phenomenon whose mechanism is shown diagrammatically in FIG. 4*a*, is caused because since the first toner image 21 is positively charged through frictional electrification and since the carrier 22 of the second developer is negatively charged through frictional electrification as in the first developing step, then the first toner 21 is electrostatically attracted to the carrier 22 of the second developer during the second developing step, and a part of the first toner 21 falls off from the surface of the photosensitive medium to contaminate the second developer. In FIG. 4*a*, reference numeral 23 indicates the second toner.

Figure 4B:
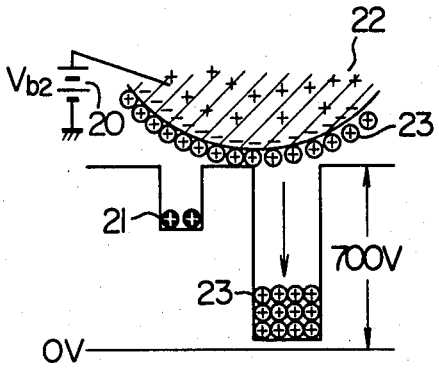

The present inventors, after having made repeated experiments, taking this mechanism in consideration, have found out that the first toner 21 can be effectively prevented from falling off from the surface of the drum if the second bias voltage $V_{b2}$ applied to the second developing unit is set higher than the first bias voltage $V_{b1}$ applied to the first developing unit, as shown in FIG. 4*b*. Preferably, the second bias voltage $V_{b2}$ should be 100~400 V, i.e. higher by about 100 V than the first bias voltage $V_{b1}$ (about 0~300 V). This effect is considered to be due to the fact that the second bias voltage biases the carrier 22 for the second developer to cause the carrier 22 to repel the first toner 21.

Figure 5:
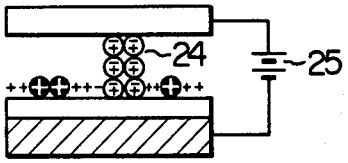
FIG. 5 illustrates the developing operation of the second developing unit in which polarizing magnetic toner is used as developing agent.

In the above description, concerning an embodiment of this invention, the second developing unit uses a two-component developer consisting of toner and carrier of, for example, iron powder. It is very convenient to apply one component developer for the second developing unit because a high bias voltage is required for the one component developer at the time of development. Alternatively, however, polarizable magnetic toner 24 having high electric resistivity may be used as the second developer, as shown in FIG. 5. In the case where the polarizable magnetic toner 24 is used to perform reversal development, the resultant printed picture becomes optimal when a bias voltage from a bias voltage source 25, approximating to the surface potential (about 700 V) of the photosensitive drum before exposure, is applied to the polarizable toner 24. Naturally, this bias voltage should be chosen to be much higher than the first bias voltage from the first bias voltage source 17. Thus, since such polarizable toner is used for development under a relatively high bias voltage, it is very effective to use the polarizable magnetic toner 24 having high resistivity as the developer in the second developing units 19.

Moreover, in the case where the polarizable magnetic toner 24 is used as the developer in the second developing unit 19, it is preferable in view of the facility in preparing the toner material to use the first developing toner for the printing of a picture having a color of thin tone and the polarizable toner for the printing of a picture having another color of thick color tone. The reason is that it is difficult to prepare thin color tone with the magnetic toner.

Figure 6:
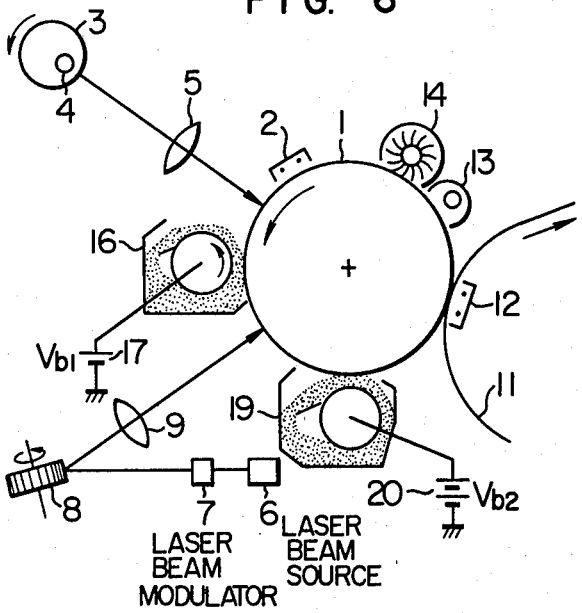
FIGS. 6 to 8 schematically show examples of a light source used for bicolor printing in this invention.
Figure 7:
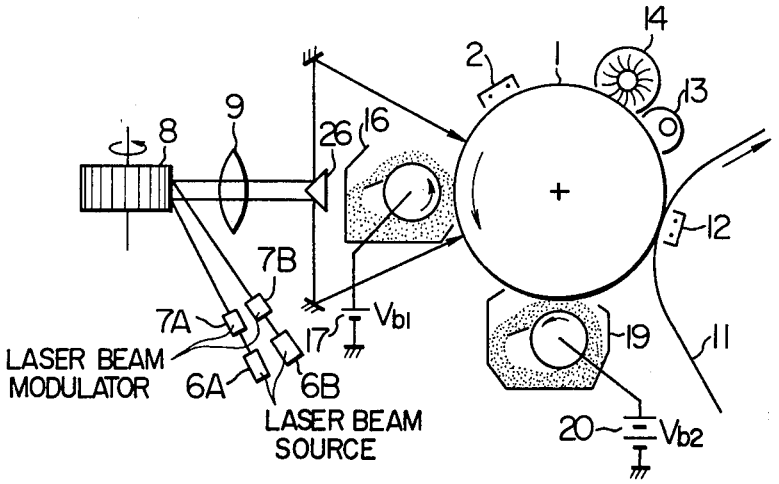
Figure 8:
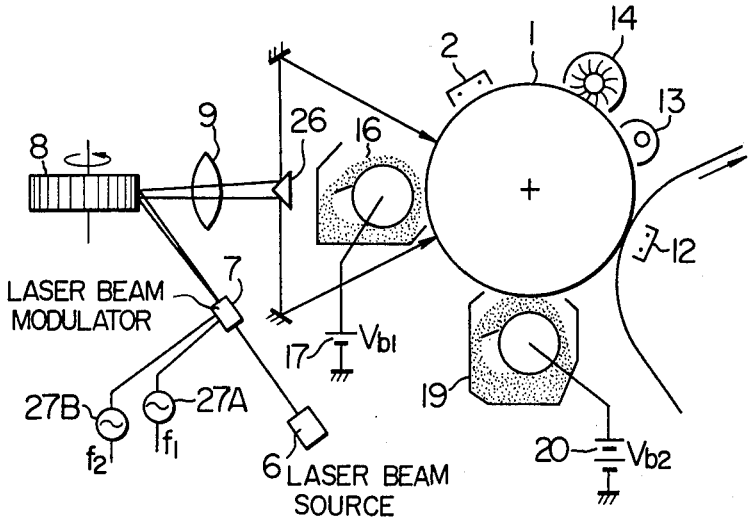

FIGS. 6 to 8 shows examples of a light source used in the bicolor printing according to this invention.

Namely, the embodiment shown in FIG. 6 employs an overlay optical system as the first exposing light source and a laser scanning system as the second exposing light source. This embodiment is adapted for the printing to display ruled lines for a document and the calculated results in different colors.

FIG. 7 shows an embodiment of this invention which uses laser beam scanning systems as both the first and the second exposing light sources. The laser beams emitted from the two laser beam sources 6A and 6B are modulated respectively by laser beam modulators 7A and 7B and further guided onto a mirror scanner 8 for simultaneously scanning. The laser beams, having left the mirror scanner 8, are diverted by a beam splitter 26 so as to be used respectively as a first and a second exposing light source. Moreover, as is apparent to those skilled in the art, if a semiconductor laser device is used as each of the laser beam sources 6A and 6B, the laser beam modulators 7A and 7B can be omitted and it suffices to place such two semiconductor laser devices in the positions where the modulators 7A and 7B are otherwise located.

FIG. 8 shows an embodiment of this invention, in which a single laser beam generated by a single source 6 is divided into two beams by a laser beam modulator 7. Such an optical modulating apparatus as the laser beam modulator 7 usually utilizes a diffraction phenomenon due to acousto-optical effect. It is well known with an acousto-optical element that if the element receiving a single beam as input is excited by two signals 27A and 27B having different frequencies $f_1$ and $f_2$, the element splits the input beam into two output beams. In this case, it should be noted that the exciting frequencies $f_1$ and $f_2$ are modulated by the associated output signals. These two output beams are introduced into the same scanning system as in FIG. 7 and then used as the first and the second exposing light sources.

In the foregoing description, although nonimpact printers of electrophotographic type are exclusively explained, this invention is by no means limited to those embodiments alone, but can be broadly applied to other electrostatic recording systems in which the formation of latent image of electric charges and the associated development is twice performed. Also, this invention can be applied to a system in which the toner image is printed directly on the recording medium as well as the system described above in which the toner image is transferred onto the recording medium.

Furthermore, if the above described printer is further provided with a unit for forming a third latent image of electric charges and a third developing units for developing the third latent image into a third visible image by using toner having a color different from the colors developed in the first and the second developing steps, the trichromatic printing can be effected. By extending this analogy, polychromatic printing using more than three colors will be easily attained. In that case, it should be noted that the bias voltages $V_{b1}$, $V_{b2}$, $V_{b3}$, etc. for the first, second, third developing units, etc. must be so set that $V_{b1} < V_{b2} < V_{b3} < \ldots$.

As described above, according to this invention, since the bias voltage for the posteriorly operated developing units is set higher than the bias voltage for the anteriorly operated developing unit, the toner image formed in the previous developing step can be prevented from falling off of the transferring medium during the succeeding development step. Accordingly, the previously developed toner image can be prevented from being damaged in the succeeding developing steps and the toner used in the previous developing step can be prevented from contaminating the toner used in the succeeding developing step to deteriorate the quality of the later developed toner images, whereby a clear picture printed in at least two colors can be obtained.

We claim:

1. A nonimpact printer comprising: a recording medium movable in a predetermined direction; single charging means for uniformly charging said recording medium; means for forming a first latent image of electric charges on said recording medium; first developing means for developing said first latent image into a first visible image; means for forming a second latent image of electric charges on said recording medium with said first visible image formed thereon; and second developing means for developing said second latent image into a second visible image having a color different from that of said first visible image, the bias voltage for said second developing means being set higher than the bias voltage of said first developing means, said single charging means, said first latent image forming means, said first developing means, said second latent image forming means, and said second developing means being arranged, in that order, in the direction of movement of said recording medium whereby a visible image of a plurality of colors is formed on said recording medium during one cycle of movement of said recording medium.

2. A nonimpact printer as claimed in claim 1, wherein said second developing means uses one component developer having a high electric resistivity.

3. A nonimpact printer as claimed in claim 1, wherein said second developer means uses a developer including polarizable magnetic toner having a high electric resistivity.

4. A nonimpact printer as claimed in claim 1, wherein the tone of the developer used in said second developing means is lower than the tone of the developer used in said first developing means.

5. A nonimpact printer according to claim 1, wherein the bias voltages of said first and second developing means are of the same polarity.

6. A nonimpact printer comprising: a drum-like rotary photosensitive medium mounted for rotary movement in a predetermined direction; single charging means for uniformly charging the surface of said photosensitive medium; first exposure means for exposing the uniformly charged surface of said photosensitive medium to an exposure light of a first exposure light source thereby to form a first latent image on the surface of said photosensitive medium in which electron charges are discharged from an area thereof desired to allow a toner to adhere; first developing means for forming a first toner image by allowing a first toner of one color to adhere to an area from which electron charges are discharged with reversal development of said first latent image by said first toner charged at the same polarity as that of the uniform charge; second exposure means for exposing the surface of said photosensitive medium to exposure light of a second exposure light source to form a second latent image in the area where electron charges remain other than the area where the first toner image is formed on the surface of said photosensitive medium; second developing means for forming a second toner image by allowing a second toner of another color to adhere to the area from which electron charges are discharged with reversal development of said second latent image by said second toner charged at the same polarity as that of the uniform charge; and transfer means for simultaneously transferring said first and second toner image formed on the surface of said photosensitive medium to a recording medium; said single charging means, said first exposure means, said first developing means, said second exposure means, said second developing means, and said transfer means being arranged, in that order, in the direction of rotary movement of said drum-like rotary photosensitive medium, whereby a toner image of a plurality of colors is formed on said photosensitive medium during one cycle of rotation of said photosensitive medium.

7. A nonimpact printer according to claim 6, wherein said first and second exposure light sources each comprise a laser beam generator.

8. A nonimpact printer according to claim 6, wherein said first and second exposure light sources comprise a first laser beam generator for producing a first laser beam corresponding to said first exposure light source and a second laser light generator for generating a second laser beam corresponding to said second exposure light source, respectively, and said first and second exposure light sources comprise single mirror scanner means for deflection scanning of said first and second laser beams.

9. A nonimpact printer according to claim 6, wherein said first and second exposure light sources comprise means for splitting a laser beam produced from a single laser beam generator into a first and a second laser beam and single mirror scanner means for deflection scanning of said first and second laser beams.

10. A nonimpact printer according to claim 8 or 9, comprising a single lens, said first and second laser beams subjected to deflection scanning by said single mirror scanner means being guided into said first and second exposed positions through said single lens.

11. A nonimpact printer according to claims 6, 7, 8 or 9, wherein said first and second developer means each comprise a bias power source for providing a bias voltage having the same polarity as the uniform charge, the bias voltage applied to said second developer means being higher than that applied to said first developer means.

* * * * *